United States Patent [19]

Oike

[11] Patent Number: 4,984,710

[45] Date of Patent: Jan. 15, 1991

[54] ARTICLE DISPENSING MECHANISM FOR CYLINDRICAL ARTICLES

[75] Inventor: Katsumi Oike, Kobayashi, Japan

[73] Assignee: Sanden Corporation, Gunma, Japan

[21] Appl. No.: 355,353

[22] Filed: May 23, 1989

[30] Foreign Application Priority Data

May 23, 1988 [JP] Japan ..... 63-66746[U]

[51] Int. Cl.[5] ..... B65H 31/20

[52] U.S. Cl. ..... 221/242

[58] Field of Search ..... 221/242, 67

[56] References Cited

U.S. PATENT DOCUMENTS

| | | | |
|---|---|---|---|
| 2,890,813 | 6/1959 | Childers et al. | 221/242 |
| 3,348,733 | 10/1967 | Johnson | 221/242 |
| 3,361,506 | 1/1968 | Newberry | 221/242 |
| 3,498,497 | 3/1970 | Baxendale et al. | 221/116 |
| 3,613,945 | 10/1971 | Rockola | 221/295 |
| 3,871,059 | 3/1975 | Goldenstein | 221/242 X |
| 4,456,147 | 6/1984 | Tominaga | 221/67 |
| 4,561,564 | 12/1985 | Negishi | 221/67 |
| 4,632,257 | 12/1986 | Negishi et al. | 221/241 |
| 4,685,590 | 8/1987 | Negishi et al. | 222/241 |

*Primary Examiner*—Andres Kashnikow

*Assistant Examiner*—K. DeRosa

*Attorney, Agent, or Firm*—Banner, Birch, McKie & Beckett

[57] ABSTRACT

An article dispensing mechanism for a vending machine is disclosed which includes a pair of side plates which face one another at a predetermined spacing. One pair of serially cusp-shaped vertical panels are disposed transversely between the side plates to define a serpentine track. An upper, open end of the serpentine track is connected to an article loading space and a lower, open end of the serpentine track is connected to an article dispensing space. A spacer member extends vertically and is movable horizontally within a space defined between either one of the side plates and the serpentine track. At least one bracket is connected with the other side plate and, adjacent fixing plates on the spacer member. At least one of the spacer fixing plates or brackets are provided with projections, e.g. screws that can be tightened. At least the other one of the spacer fixing plates or brackets are provided with apertures. The projections are fitted within the apertures and secured to determine a position of the spacer. The depth of the dispensing passage may be adjusted to compensate for a wide variety of articles.

1 Claim, 2 Drawing Sheets

ARTICLE DISPENSING MECHANISM FOR CYLINDRICAL ARTICLES

TECHNICAL FIELD

This invention relates to an article dispensing mechanism for a vending machine and, more particularly, to a serpentine mechanism for the dispensing of various sizes of cylindrical articles.

BACKGROUND OF THE INVENTION

It is generally known in the art of dispensers for cylindrical articles that the storage capacity of the device is increased by utilizing a serpentine storage and dispensing track without having to increase the outer configuration of the article storage area. As shown in U.S. Pat. Nos. 3,498,497 and 3,613,945 (which are incorporated herein by reference), serpentine tracks have a sinusoidal shape from top to bottom which causes the cylindrical articles to roll down via gravity from the upper end thereof to a discharge opening at the lower end thereof. Delivery of these cylindrical articles from the discharge opening is controlled by a discharge control device disposed at the discharge opening.

In a serpentine track dispensing mechanism of the above type, the width of each serpentine pathway can be slightly changed to adapt to articles of various diameters. Likewise, a mechanism for adjusting the horizontal length of the track, i.e. the depth of the pathway, is disclosed in U.S. Pat. No. 4,685,590 and is herein incorporated by reference. However, a variety of dimensional errors can occur with these mechanisms which allow the article to twist as it rolls and block the passage.

SUMMARY OF THE INVENTION

It is a primary object of the invention to provide an improved article dispensing mechanism for vending machines that utilizes a serpentine track in which the depth of the resulting passageway may be adjusted to compensate for the various types of articles utilized.

It is another object of this invention to provide an article dispensing mechanism for vending machines which is simple in construction and easy to assemble.

An article dispensing mechanism for a vending machine according to the present invention includes a first side plate and a second side plate which face one another at a predetermined spacing. Pairs of serially cusp-shaped vertical panels are disposed substantially horizontally between the side plates to define vertically progressive serpentine track. An upper end of the serpentine track is open and connected to an article loading space. A lower end of the serpentine track is connected to an article dispensing space. A vertically extending spacer member is horizontally movable within a space defined between the second side plates and the serpentine track. Means for adjusting the horizontal position of said spacer member relative to the track permits the dispensing of a variety of generally cylindrical articles which may not have the same height as other articles within adjacent serpentine tracks.

Further objects, features and other aspects of this invention will be understood from the following detailed description of the preferred embodiment of this invention referring to the attached drawings.

DETAILED DESCRIPTION OF THE INVENTION

Figure 1:
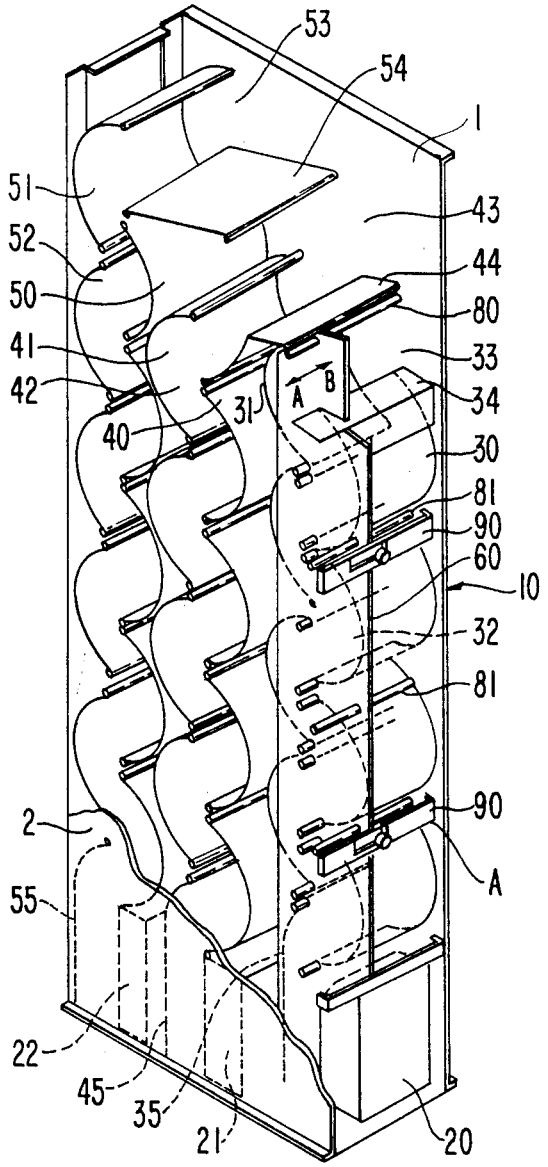
FIG. 1 is a perspective view of an article storage area of a vending machine according to an embodiment of this invention having three serpentine tracks for the dispensing mechanism.

Referring to FIG. 1, an article storage device 10 includes a pair of side plate such as first side plate 1 and second side plate 2 and a plurality of serially cusp-shaped vertical panels 30, 31, 40, 41, 50 and 51. These panels define a serpentine track 32, 42, and 52 between each pair of facing panels 30 and 31, 40 and 41, 50 and 51, respectively. Side panels 1 and 2 are suitably connected together to be parallel to each other and define therebetween a predetermined gap which provides spaces for article loading and discharging.

Serially cusp-shaped vertical panels 30, 31, 40, 41, 50 and 51 are supported transversely between side plates 1 and 2. Each serpentine track 32, 42 and 52 is formed by the path between oppositely curved and vertically staggered pairs of facing vertical panels 30, 31, 40, 41, 50 and 51. The semi-cylindrical cusp portions alternate with one another to form a progressive serpentine path, i.e., the semi-cylindrical cusp portions on one panel 30, 40 and 50 are vertically staggered with respect to the oppositely curved panels 31, 41 and 51. The width of the space between each alternating track is preferably slightly greater than the diameter of the largest article it is contemplated the dispensing mechanism will need to accommodate. Of course, it is intended that the mechanism will be constructed to handle articles of several different diameters.

The upper portion for each serpentine track 32, 42 and 52 communicates with its own article loading space 33, 43, and 53 by way of guide plates 34, 44 and 54, respectively. The lower portion of each serpentine track 32, 42 and 52 is connected to its own articles discharging space formed by guide plates 35, 45 and 55 adjacent which discharge control devices 20, 21 and 22 are disposed.

Figure 2:
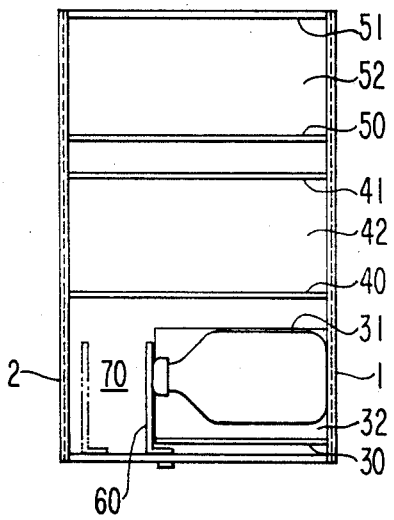
FIG. 2 is a top cross-sectional view of an article storage area of a vending machine as shown in FIG. 1.

As shown in FIG. 2, cusp-shaped vertical panels 30 and 31 contact first side plate 1 at one end and extend toward second side plate 2. The width of panels 30 and 31 is smaller than that of cusp-shaped vertical panels 40, 41, 50 and 51 disposed between first side plate 1 and second side plate 2. Accordingly, space 70 is defined between cusp-shaped vertical panels 30 and 31 and second side plate 2.

Figure 3:
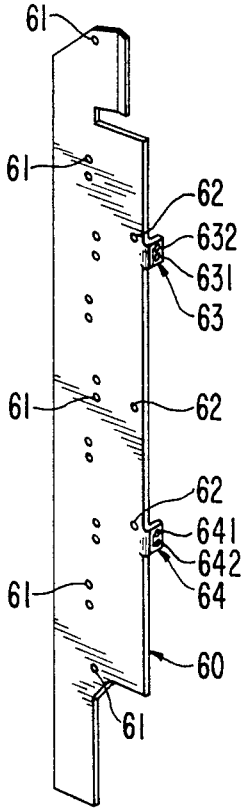
FIG. 3 is a perspective view of a side spacer as shown in FIG. 1.

The construction of side spacer member 60 is shown in FIG. 3. Side spacer member 60 is a generally planar panel which includes a plurality of apertures 61. The apertures 61 are vertically aligned along and to either side of the centerline of spacer member 60. Three apertures 62 are vertically aligned along one lateral edge of spacer member 60. Side spacer fixing plates 63 and 64 are formed integral with side spacer 60 as bends in the planar surface of spacer 60, and both extend in a direction generally perpendicular to spacer 60 (parallel to guide plate 34). Projections 631 and 641 are formed on fixing plates 63 and 64 at the upper ends of each. Threaded holes 632 and 642 are formed on each projection at its lower end.

As shown in FIG. 1, guide axles 80 traverse the distance between first and second side plates 1, 2 and are disposed to correspond to apertures 61. Likewise, guide axles 81 traverse the distance between side plates 1 and 2 and disposed to correspond to apertures 62. Side spacer member 60 is positioned to allow guide axles 80 and 81 to pass through apertures 61 and 62, thereby becoming supported vertically but horizontally movable within space 70. Movement within space 70 adjusts the depth of the dispensing path to fit the articles being dispensed.

Figure 4:
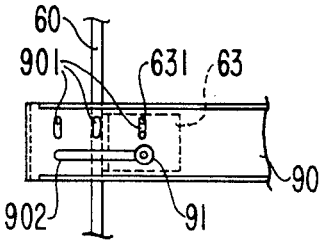
FIG. 4 is an enlarged perspective view of portion A as shown in FIG. 1.

FIG. 4 is an enlarged perspective view of a means for adjusting the depth of spacer member 40 according to the present invention. Depth brackets 90 extend from side plate 1 toward side plate 2 and horizontally extend to correspond to fixing plates 63 and 64. A plurality of apertures 901 for inserting projections 631 and 641 of fixing plates 63 and 64, respectively, are formed on the upper end of brackets 90. Likewise, longitudinal apertures 902 are formed on the lower end of brackets 90 to correspond to threaded holes 632 and 642 of fixing plates 63 and 64 and extend in the horizontal direction. Fixing plates 63 and 64 are connected with brackets 90 by means for adjustably securing plate 60 to brackets 90, e.g. screws 91 through longitudinal apertures 902.

The procedure of adjusting the depth of serpentine track 32 by moving and securing side spacer 60 allows the dispenser to handle a wide variety of articles. The adjustments are readily performed: (a) side spacer 60 is moved horizontally to correspond to the depth of a stored article; (b) projections 631 and 641 are inserted into apertures 901, respectively; and (c) screws 91 are tightened to connect fixing plates 63 and 64 with brackets 90.

Thus, the horizontal length of the loading space and serpentine track are easily adjusted and maintained in a secure position. As a result of adjusting the horizontal length of the serpentine track, the articles roll smoothly down along the serpentine track without twisting or rising up to become jammed.

This invention has been described in detail in connection with one certain embodiment. The embodiments, however, are merely for illustrative purposes only and the scope of the invention as defined in the appended claims is not to be restricted thereto. It will be understood by those skilled in the art that variations and modifications can be easily made, particularly in matters of size, shape and arrangement of parts, within the scope of this invention. For example, more than one of the dispensing paths may use a spacing member that can be secured in position with, inter alia, wing nuts, pins, clips, and spring loaded pins or clips.

I claim:

1. In an article dispensing mechanism for use in a vending machine, said mechanism comprising first and second side plates facing one another at a predetermined spacing;

at least two pairs of serially cusp-shaped panels disposed substantially horizontally between said side plates to define at least first and second vertically progressive serpentine tracks each of which has an upper end and a lower end;

an article loading space communicating with each said upper end; and an article dispensing space communicating with each said lower end, the improvement comprising:

a vertically extended, generally planar spacer member that is horizontally movable between said second side plate and said first side plate along said first serpentine track to adjust the depth of said first serpentine track relative to said first side plate independently of the depth of said second serpentine track, said spacer member exhibiting fixing plates extending perpendicular to the generally planar surface of the spacer member; and adjustment means for releasably adjusting the horizontal position of said spacer member relative to said first side plate, said adjustment means comprising at least one bracket connected to said first side plate and extending toward said side plate, and a screw passing through a longitudinal aperture in one of the brackets and into a threaded hole in one of the fixing plates.

* * * * *